US009227330B2

(12) United States Patent
Fellows et al.

(10) Patent No.: US 9,227,330 B2
(45) Date of Patent: Jan. 5, 2016

(54) FOLDING KNIFE

(75) Inventors: Michael William Fellows, Western Cape (ZA); Stephanus Richuard Conradie, Stillbaai (ZA)

(73) Assignee: Wilcospex (Proprietary) Limited, Still Bay (ZA)

( * ) Notice: Subject to any disclaimer, the term of this patent is extended or adjusted under 35 U.S.C. 154(b) by 197 days.

(21) Appl. No.: 14/115,966

(22) PCT Filed: May 6, 2012

(86) PCT No.: PCT/EP2012/058321

§ 371 (c)(1),
(2), (4) Date: Nov. 6, 2013

(87) PCT Pub. No.: WO2012/152730

PCT Pub. Date: Nov. 15, 2012

(65) Prior Publication Data

US 2014/0047718 A1 Feb. 20, 2014

(30) Foreign Application Priority Data

May 6, 2011 (ZA) ..... 11/3328

(51) Int. Cl.
*B26B 1/04* (2006.01)
*B26B 1/02* (2006.01)

(52) U.S. Cl.
CPC . *B26B 1/042* (2013.01); *B26B 1/02* (2013.01); *B26B 1/04* (2013.01); *B26B 1/048* (2013.01)

(58) Field of Classification Search
CPC ..... B26B 1/02; B26B 1/04; B26B 1/042; B26B 1/048
USPC ..... 30/153, 155–157, 161, 329–331, 340, 30/342
See application file for complete search history.

(56) References Cited

U.S. PATENT DOCUMENTS 4,604,803 A * 8/1986 Sawby ..... B26B 1/048 30/155
6,826,836 B1 * 12/2004 Lin ..... B26B 1/048 30/155
2006/0130337 A1 * 6/2006 Voros ..... B26B 1/046 30/153
2007/0101579 A1 * 5/2007 Kain ..... B26B 1/048 30/161

FOREIGN PATENT DOCUMENTS

FR 2881073 A1 7/2006

* cited by examiner

*Primary Examiner* — Ned Landrum
*Assistant Examiner* — Liang Dong
(74) *Attorney, Agent, or Firm* — BainwoodHuang

(57) ABSTRACT

A folding knife includes an elongated blade, an elongated handle, a disc-shaped cam, and a cam mechanism. The blade defines a cam-receiving aperture having a generally circular profile and a blade notch which is disposed adjacent to and which opens into the cam-receiving aperture. The handle includes a locking formation for releasable engagement with the blade notch. The configuration of the cam and the relative positions of the blade notch and the locking formation are such that when the blade is in the extended position, the locking formation is releasably captured in the blade notch.

8 Claims, 6 Drawing Sheets

FOLDING KNIFE

BACKGROUND

The invention relates to a folding knife. In this specification the term "folding knife" must be interpreted sufficiently broadly to mean any type of a folding tool having an elongate workpiece, such as, for example, a blade, a shank or a stem. Furthermore, any reference in this specification to an "elongate blade" must be interpreted to mean any elongate workpiece such as, for example, a blade, a shank or a stem.

SUMMARY

According to the invention there is provided a folding knife including:

an elongate blade having a free end and an opposite handle mounting end, the blade defining a longitudinal axis which extends between the ends, the blade defining a cam-receiving aperture having a generally circular profile and a blade notch which is disposed adjacent to and which opens into the cam-receiving aperture;

an elongate handle having a free end and an opposite blade mounting end, the handle defining a longitudinal axis which extends between the ends, the handle including a locking formation for releasable engagement with the blade notch of the blade;

a disc-shaped cam having a generally circular peripheral outer edge, which is pivotally mounted to the handle in an arrangement permitting pivotal displacement of the cam relative to the handle about a pivot axis which is offset from a centre of the cam, the cam being received within the cam-receiving aperture of the blade in an arrangement permitting rotation of the cam within the cam-receiving aperture, thereby providing for mounting of the blade to the cam and rotational displacement of the blade relative to the handle between a folded condition wherein the blade is folded onto the handle and an extended condition wherein the longitudinal axes of the blade and the handle are substantially aligned, the cam defining a cam notch in which the locking formation of the handle can be received, thereby permitting linear displacement of the cam and the blade relative to the handle when the locking formation is received in the cam notch;

a cam mechanism for regulating the linear displacement of the cam relative to the handle, the cam mechanism including biasing means for biasing the cam and thereby the blade mounted thereto, in a predetermined linear direction relative to the handle; and an abutment formation which is fixed to the handle against which the biasing means abuts and is placed under tension when the cam is displaced in the predetermined linear direction, the configuration of the cam and the relative positions of the blade notch and the locking formation being such that when the blade is in the extended position, the locking formation is releasably captured in the blade notch, with a peripheral edge of the cam blocking the release of the locking formation, displacement of the blade into its folded condition from its extended condition, being achieved by exerting a force on the blade against the force of the biasing means so as to displace the blade notch in the linear direction away from the locking formation while rotating the blade relative to the cam so as to bring the cam notch into register with the blade notch thereby permitting the locking formation to be received within the cam notch so as to release the locking formation from the blade notch and permit rotation of the blade relative to the cam.

The handle may include a stop formation against which the blade abuts in its extended condition and in its folded condition, the stop formation acting as a stop for preventing further rotational displacement of the blade beyond its extended condition when displacing the blade from its folded condition and for preventing further rotational displacement of the blade beyond its folded condition when displacing the blade from its extended condition.

The blade may define a second blade notch in which the stop formation is received when the blade is in its extended condition. More specifically, the second blade notch may be defined in an edge of the handle mounting end of the blade.

The folding knife may define a third blade notch which is disposed adjacent to and which opens into the cam-receiving aperture, the third blade notch being disposed substantially diametrically opposite the blade notch such that the locking formation is releasably captured in the third blade notch when the blade is in the folded condition.

The locking formation and the additional locking formation of the handle may be positioned relative to one another such the locking formation is located relatively closer to the longitudinal axis of the handle than the additional locking formation, thereby providing for the position of the locking formation and the additional locking formation to be laterally offset from one another. Furthermore, the locking formation may be positioned relatively closer to the blade mounting end of the handle than the additional locking formation, thereby providing for the positions of the locking formation and the additional locking formation to be longitudinally offset.

The folding knife may include a pair of covers wherein each cover of the pair of covers is disposed at a side of the cam-receiving aperture for closing off the side thereby retaining and covering the cam and the cam mechanism within the cam-receiving aperture.

BRIEF DESCRIPTION OF THE DRAWINGS

Further features of the invention are described hereinafter by way of a non-limiting example of the invention, with reference to and as illustrated in the accompanying schematic drawings. In the drawings.

DETAILED DESCRIPTION

Figure 1:
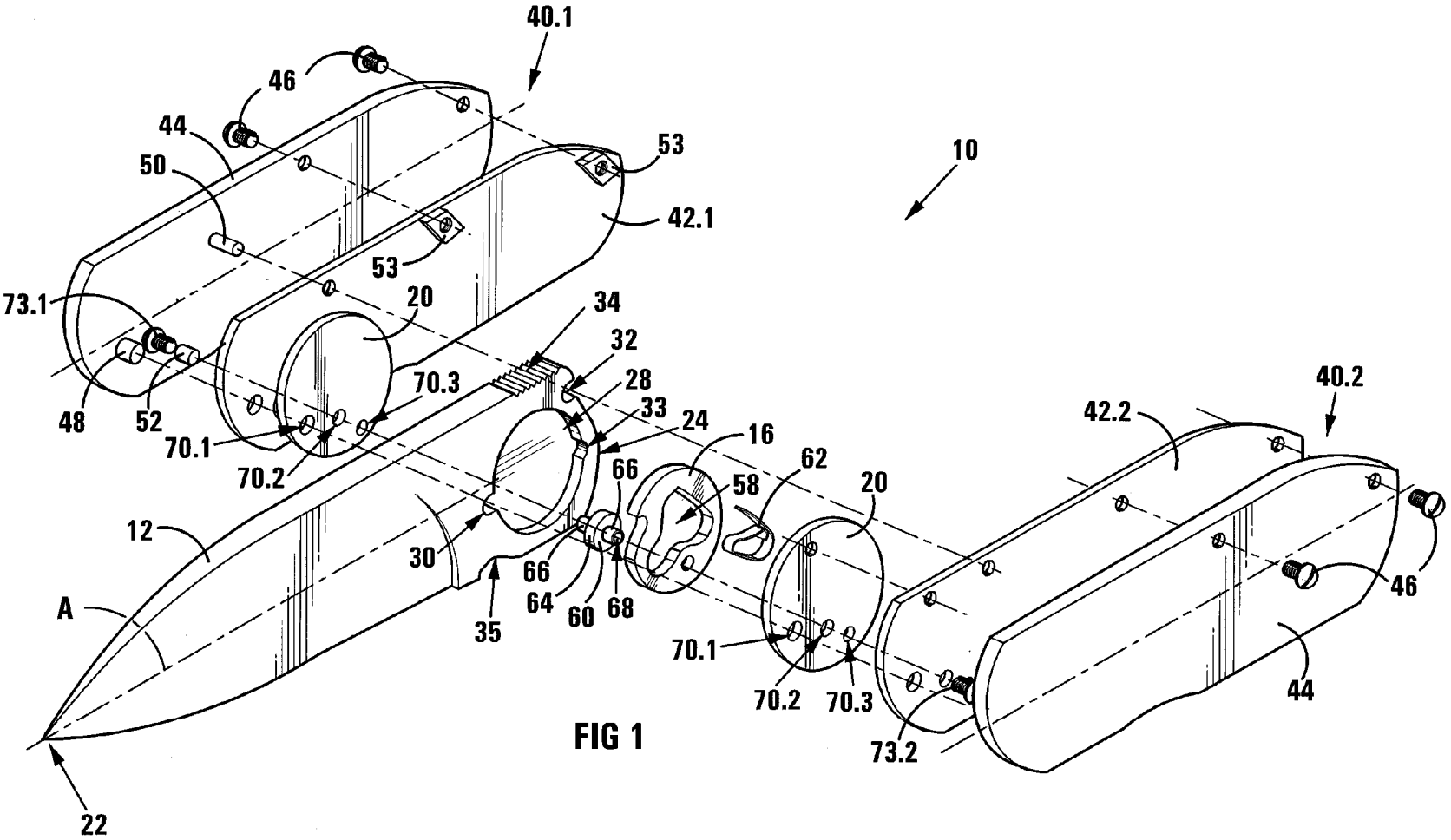
FIG. 1 shows an exploded perspective view of a folding knife in accordance with the invention.

With reference to the drawings, a folding knife in accordance with the invention, is designated generally by the reference numeral 10.

The folding knife 10 includes a blade 12, a handle 14, a cam 16, a cam mechanism 18 and a pair of disc-shaped bearing covers 20.

The blade 12 has an elongate configuration having a free end 22 and an opposite handle mounting end 24 and defines a longitudinal axis A which extends between the ends 22 and 24. The blade 12 defines a cam-receiving aperture 28 having a generally circular configuration, in which the cam 16 is received. The cam-receiving aperture 28 has a centre C when viewed in plan view and defines an axis of rotation through the centre about which the blade 12 is rotatable. The cam is rotatably mounted within the cam-receiving aperture. The blade defines a first blade notch 30, a second blade notch 32 and a third blade notch 33. The first blade notch 30 is defined adjacent the cam-receiving aperture 28 and opens into the cam-receiving formation. The second blade notch 32 is defined in an edge of the blade at its handle mounting end 24. The third blade notch 33 is disposed diametrically opposite the first blade notch 30 adjacent the cam-receiving aperture 28 and opens into the cam-receiving aperture. The blade further defines a serrated thumb grip 34 and a cut-out 35.

The handle 14 has an elongate configuration having a free end 36 and an opposite blade mounting end 38, and defines a longitudinal axis B which extends between the free end 36 and the opposite blade mounting end 38. The handle includes two handle halves 40. The handle halves 40.1 and 40.2 include inner liner plate 42.1 and 42.2, respectively, and a relatively thicker outer cover plate 44. The blade 12 is rotatably received between the handle halves. The folding knife is assembled such that the handle halves are spaced apart so as to define a gap within which the blade is received. The handle half 40.1 additionally defines a locking formation in the form of a locking pin 48, a stop formation in the form of a stop pin 50 and a pivot pin 52. The inner liner plate 42.1 additionally includes a pair of inwardly extending spacer bushes 53 which define internally screw threaded bores at opposite ends thereof. The handle halves 40.1 and 40.2 are connected to one another by means of screws 46 which are received in countersunk holes defined in the outer plates 44 and aligned holes defined in the associated inner plates 42. The spacer bushes 53 space the handle halves from one another so as to define an internal space within which the blade is received in a folded condition thereof. More specifically, the screws 46 are screwed into the threaded bores defined in the ends of the spacer bushes 53.

The cam 16 has a disc-like configuration and is configured to be pivotally mounted to the handle 14 in an arrangement permitting linear displacement of the cam 16 relative to the handle 14, as will be described in more detail below. The cam 16 comprises a cam body defining a cam notch 54, a pivot-receiving aperture 56 and a bell-shaped cam mechanism-receiving aperture 58 in which the cam mechanism 18 is received. The cam body has a generally circular peripheral outer edge which is received within the cam-receiving aperture 28 of the blade 12 in a contact fit permitting rotation of the cam 16 within the cam-receiving aperture 28 of the blade_ The cam notch 54 is dimensioned and configured for receiving the locking pin 48 therein. The pivot-receiving aperture 56 is configured for receiving the pivot pin 52 therein, for pivotally mounting the cam 16 to the handle 14 at a position which is offset a distance 'X' from the centre C of the cam 16 when the cam is viewed in plan view (see FIG. 3).

The cam mechanism 18 is configured for regulating linear displacement of the cam 16 and includes an abutment formation in the form of an abutment pin 60 and biasing means in the form of a torsion spring 62. As is most clearly shown in FIG. 1, the abutment pin 60 includes a central disc 64 and two cylindrical end pin sections 66 which extend outwardly from opposite ends of the central disc 64. A central passage 68 extends centrally through the abutment pin 60. The central passage 68 is threaded at its opposite ends, with openings of the passage being defined at free ends of the end pin sections. The abutment pin 60 is received within a part of the cam mechanism-receiving aperture 58 of the cam 16 and is fixed to the handle halves 40 by means of screws. The spring 62 is received in the cam mechanism-receiving aperture 58 and is shaped so as to conform to the shape of part of the aperture 58 against which the spring abuts. The spring 62 also abuts against the abutment pin 60, causing the spring 62 to be placed under tension when the cam 16 is displaced in a linear direction as is explained hereinbelow.

The bearing covers 20 are in the form of relatively thin plates and have a circular configuration when viewed in plan view. Each bearing covers 20 has three holes 70.1, 70.2, 70.3 defined therein. Each bearing cover 20 has a circular outer profile, the diameter of the retaining disc being slightly larger than the diameter of the cam-receiving aperture 28 of the blade 12. The holes 70.2 of the covers 20 each receive a different one of the cylindrical end pin sections 66 of the abutment pin 60 therethrough. Locking pin 48 and pivot pin 52 are received in the holes 70.1 and 70.3. The bearing covers 20 thus close off opposite sides of the cam-receiving aperture 28 thereby retaining the cam and the cam mechanism within the cam-receiving aperture and preventing the ingress of dirt.

Each liner plate 42 also defines holes 71.1, 71.2 and 71.3 which are in register with the holes 70.1, 70.2 and 70.3 of the retaining discs 20 and in which the loading pin 48, pivot pin 52 and end pin section 62, respectively, are received. The bearing covers 20 and the liner plates 42 are screwed onto the abutment pin 60 by means of screws 73.1 and 73.2 which are screwed into the threaded ends of the end pin sections 66 thereby securing the bearing covers to the sides of the cam-receiving aperture 28. The screws 73.1 and 73.2 are tightened to a required torque such that outer peripheral portions of the bearing covers bear against portions of the blade 12 surrounding the cam-receiving aperture, thereby preventing the ingress of dirt into the cam-receiving aperture and the blade notch 30.

Figure 2:
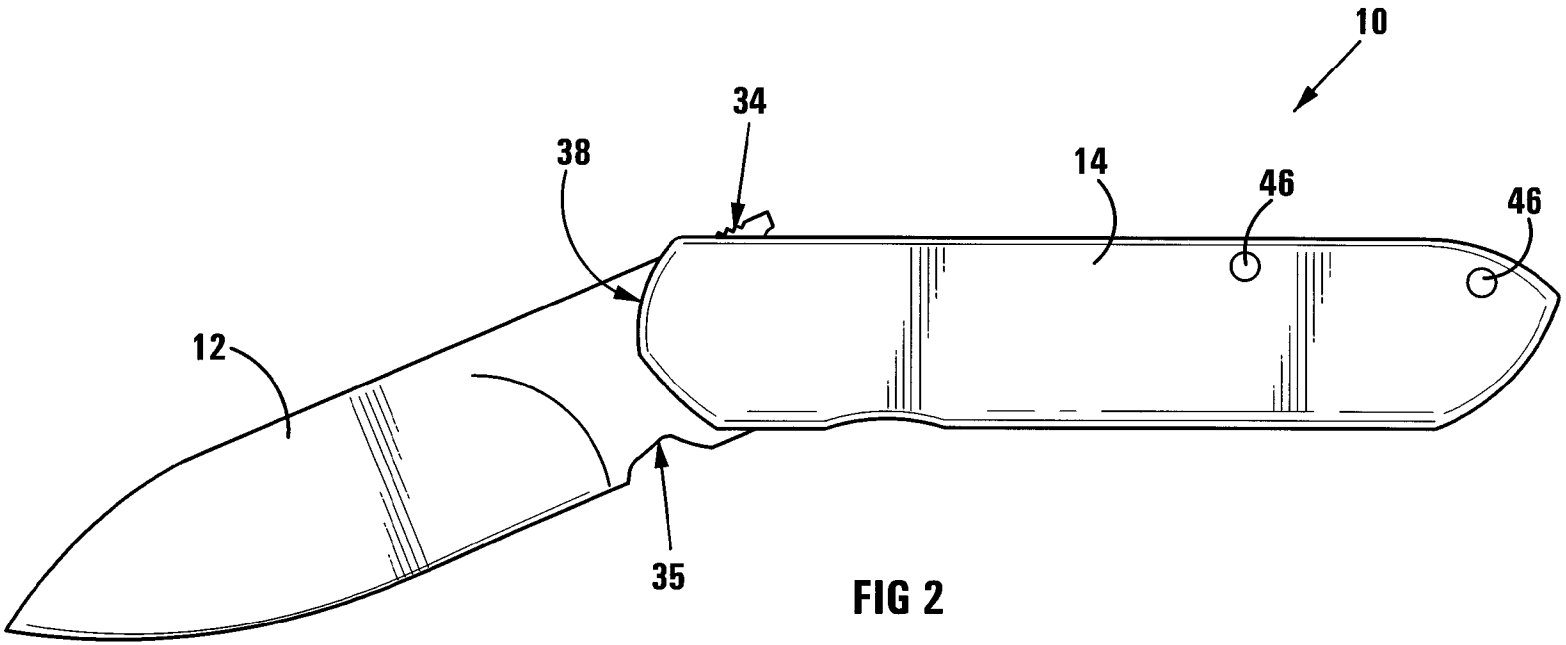
FIG. 2 shows a side view of the folding knife of FIG. 1.
Figure 3:
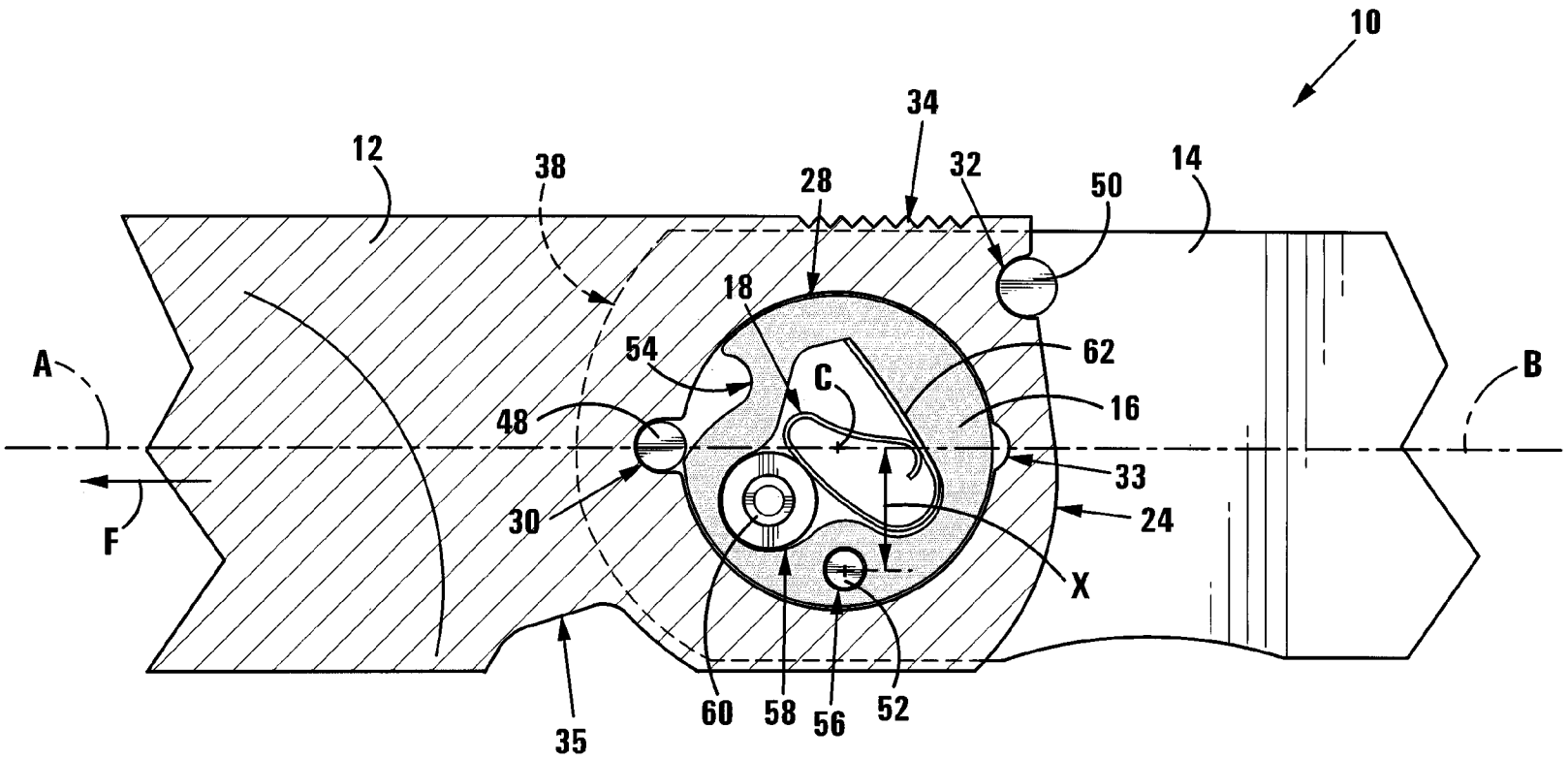
FIG. 3 shows a fragmentary enlarged plan view of the folding knife of FIG. 1, shown with a blade of the folding knife in its extended condition.
Figure 6:
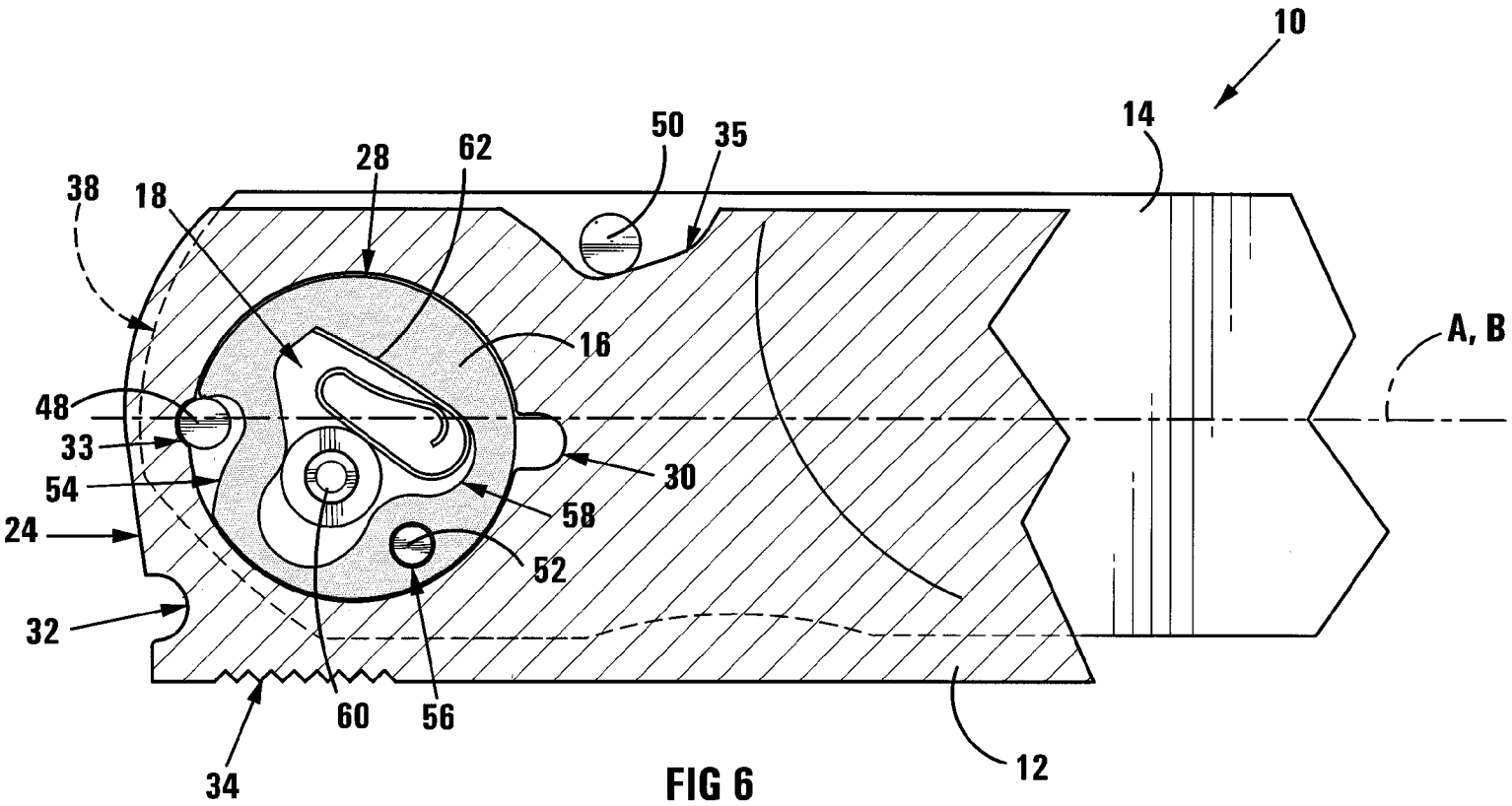
FIG. 6 shows a fragmentary enlarged plan view of the folding knife of FIG. 1, shown with the blade of the folding knife in its folded condition.

In use, it will be appreciated that when the cam 16 is mounted to the blade 12, the contact fit between the cam and the cam-receiving aperture 28 of the blade permits rotation of the cam within the cam-receiving aperture 28 of the blade 12, thereby providing for rotational displacement of the blade 12 between a folded condition (as shown in FIG. 6) wherein it is folded onto the handle 14 so as to be received between the handle halves 40 and an extended condition (as shown in FIGS. 2 and 3) wherein the longitudinal axis A of the blade 12 and the longitudinal axis 13 of the handle 14 are aligned.

Figure 4:
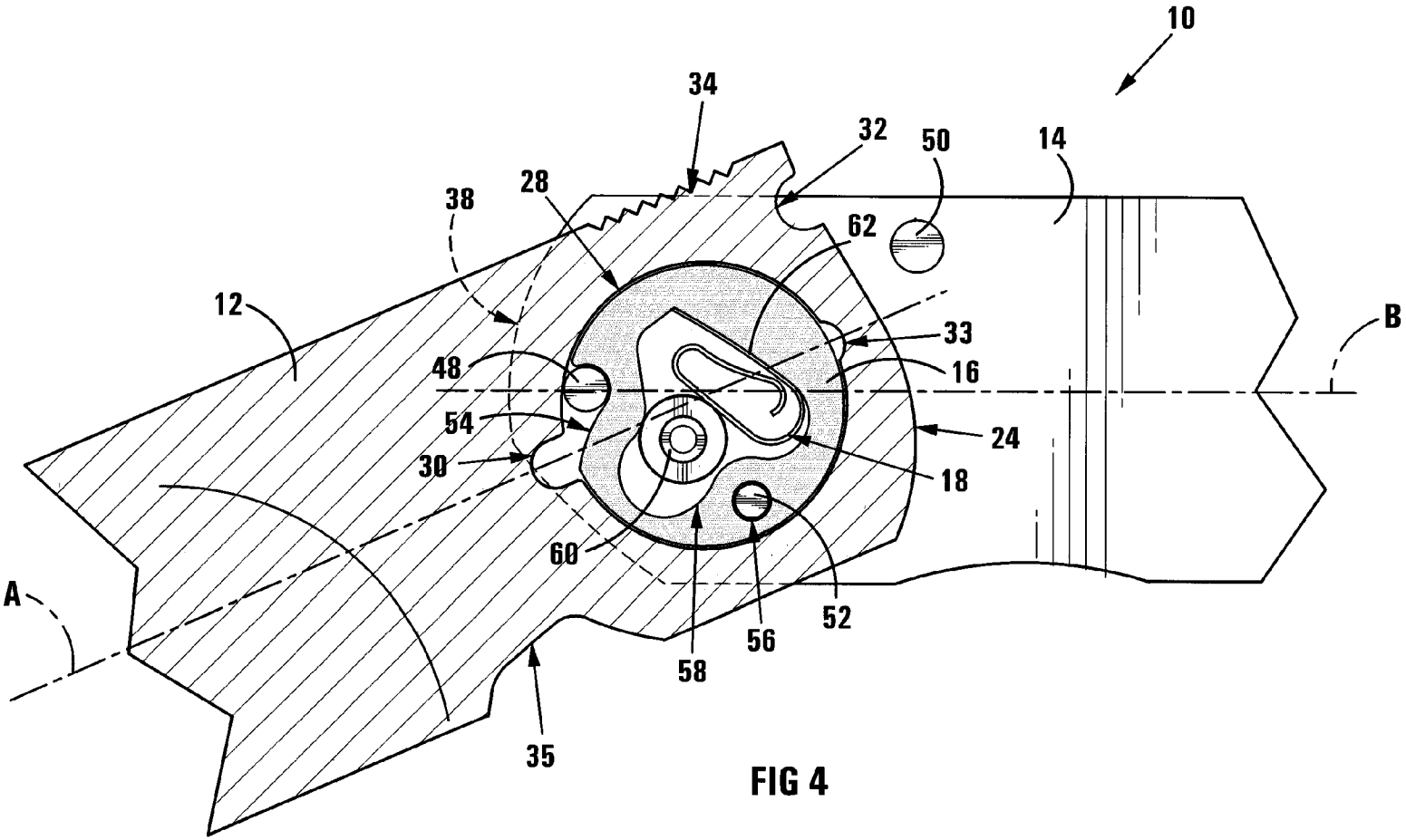
FIG. 4 shows a fragmentary enlarged plan view of the folding knife of FIG. 1, shown with the blade being rotated relative to the handle from its extended condition into its folded condition.
Figure 5:
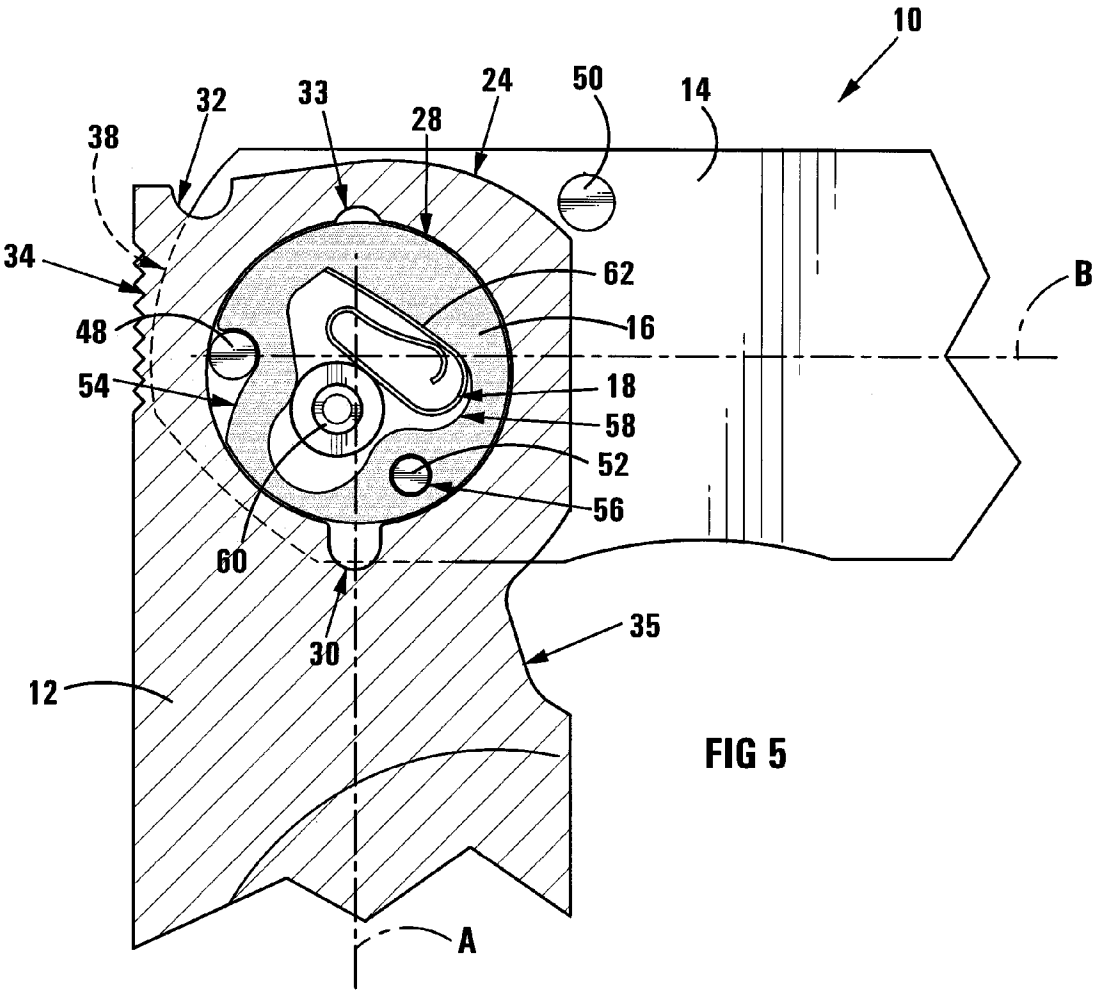
FIG. 5 shows a fragmentary enlarged plan view of the folding knife of FIG. 1, shown with the blade being further rotated relative to the handle from its extended condition into its folded condition.

The configuration of the cam and the relative positions of the first blade notch 30 and of the locking pin 48 are such that when the blade 14 is in its extended condition, the locking pin is releasably captured in the first blade notch 30, with a peripheral edge of the cam blocking the release of the locking pin as is shown in FIG. 3. The blade 12 is released so as to permit displacement into its folded condition, by exerting a force on the blade 12 against the force of the spring 62 so as to displace the blade 12 in a linear direction 'F' as shown in FIG. 3 relative to the handle 14. This causes the second blade notch 32 to be displaced away from the stop pin 50 and the first blade notch 30 to be displaced away from the locking pin 48. The blade is then slightly rotated relative to the cam 16 so as to bring the cam notch 54 into register with the first blade notch 30. This allows the locking pin 48 to be released from the first blade notch 30 and received within the cam notch 54, as is shown in FIG. 4 of the drawings.

Rotation of the blade into its folded condition from its extended condition is permitted when the locking pin 48 is received in the cam notch 54 and in the third blade notch 33. Spring pressure provided by spring 62 releasably holds the locking pin 48 in the blade notch 33 thereby preventing the blade from opening accidentally when in the folded condition. In the folded condition of the blade, the stop pin 50 is received in the cut-out 35 thereby preventing further rotation of the blade.

In order to displace the blade from its folded condition into its extended condition, thumb pressure is exerted on the thumb grip 34 of the blade for commencing rotation of the blade into its extended condition. The pressure exerted on the thumb grip causes the blade notch 33 to be displaced away from the locking pin 48 thereby allowing rotation of the blade. The blade is further rotated until the first blade notch 30 is aligned with the locking pin 48 and the locking pin is releasably captured into the blade notch 30 under the action of the spring 62. In this position, the stop pin 50 is received in the second blade notch 32, preventing further rotation of the blade.

The locking pin 48 and the stop pin 50 are positioned relative to one another such that the locking pin is relatively closer to the longitudinal axis B of the handle 14 and the pins are thus laterally offset from one another. Furthermore, the locking pin 48 is positioned relatively closer to the blade mounting end 38 of the handle than the stop pin 50 and the pins are also longitudinally offset from one another. Offsetting of the locking pin and stop pin as described above, provides for the blade to be securely held in its extended position. In use, it will be appreciated that as the bearing covers 20 are larger in diameter than the diameter of the cam-receiving aperture 28 of the blade 12, the bearing covers 20 are effective in preventing particulate material such as dust and/or dirt from entering into the cam-receiving aperture 28 and hampering the operation of the cam mechanism 18 and displacement of the cam 16. More particularly, the screws 73.1 and 73.2 holding the bearing covers 20 to the abutment pin 60 are tightened to a required torque, such that outer peripheral portions of the bearing covers 20 bear against portions of the blade 12 surrounding the cam-receiving aperture 28 and the blade notch 30, thereby to keep particulate material out of the cam-receiving aperture 28 and blade notch 30, in use. The bearing covers 20 also provide bearing surfaces against which the blade bears during rotation of the blade between its extended and folded conditions. The bearing covers 20 also serve to space the blade from inner sides of the inner liner plates thereby protecting the blade from rubbing against the inner liner plates when the blade is rotated.

It will be appreciated that the exact configuration of the folding knife 10, in accordance with the invention may vary greatly while still incorporating the essential features of the invention as described hereinabove.

What is claimed is:

1. A folding knife including:

an elongate blade having a free end and an opposite handle mounting end, the blade defining a longitudinal axis which extends between said ends, the blade defining a cam-receiving aperture having a generally circular profile and a blade notch which is disposed adjacent to and which opens into the cam-receiving aperture;

an elongate handle having a free end and an opposite blade mounting end, the handle defining a longitudinal axis which extends between said ends, the handle including a locking formation for releasable engagement with the blade notch of the blade;

a disc-shaped cam having a generally circular peripheral outer edge, which is pivotally mounted to the handle in an arrangement permitting pivotal displacement of the cam relative to the handle about a pivot axis which is offset from a centre of the cam, the cam being received within the cam-receiving aperture of the blade in an arrangement permitting rotation of the cam within the cam-receiving aperture, thereby providing for mounting of the blade to the cam and rotational displacement of the blade relative to the handle between a folded condition wherein the blade is folded onto the handle and an extended condition wherein the longitudinal axes of the blade and the handle are substantially aligned, the cam defining a cam notch in which the locking formation of the handle can be received, thereby permitting linear displacement of the cam and the blade relative to the handle when the locking formation is received in the cam notch;

a cam mechanism for regulating said linear displacement of the cam relative to the handle, the cam mechanism including biasing means for biasing the cam and thereby the blade mounted thereto, in a predetermined linear direction relative to the handle; and an abutment formation which is fixed to the handle against which the biasing means abuts and is placed under tension when the cam is displaced in said predetermined linear direction, the configuration of the cam and the relative positions of the blade notch and the locking formation being such that when the blade is in the extended position, the locking formation is releasably captured in the blade notch, with a peripheral edge of the cam blocking the release of the locking formation, displacement of the blade into its folded condition from its extended condition, being achieved by exerting a force on the blade against the force of the biasing means so as to displace the blade notch in said linear direction away from the locking formation while rotating the blade relative to the cam so as to bring the cam notch into register with the blade notch thereby permitting the locking formation to be received within the cam notch so as to release the locking formation from the blade notch and permit rotation of the blade relative to the cam.

2. The folding knife as claimed in claim 1, wherein the handle includes a stop formation against which the blade abuts in its extended condition and in its folded condition, the stop formation acting as a stop for preventing further rotational displacement of the blade beyond its extended condition when displacing the blade from its folded condition and for preventing further rotational displacement of the blade beyond its folded condition when displacing the blade from its extended condition.

3. The folding knife as claimed in claim 1, wherein the blade defines a second blade notch in which the stop formation is received when the blade is in its extended condition.

4. The folding knife as claimed in claim 3, wherein the second blade notch is defined in an edge of the handle mounting end of the blade.

5. The folding knife as claimed in claim 1, wherein the blade defines a third blade notch which is disposed adjacent to and which opens into the cam-receiving aperture, the third blade notch being disposed substantially diametrically opposite the blade notch such that the locking formation is releasably captured in the third blade notch when the blade is in the folded condition.

6. The folding knife as claimed in claim 2, wherein the locking formation and the stop formation of the handle are positioned relative to one another such the locking formation is located relatively closer to the longitudinal axis of the handle than the stop formation, thereby providing for the position of the locking formation and the stop formation to be laterally offset from one another.

7. The folding knife as claimed in claim 2, wherein the locking formation is positioned relatively closer to the blade mounting end of the handle than the stop formation, thereby providing for the positions of the locking formation and the stop formation to be longitudinally offset.

8. The folding knife as claimed in claim 1, which includes a pair of covers, each cover of the pair of covers being disposed at a side of the cam-receiving aperture for closing off the side thereby retaining and covering the cam and the cam mechanism within the cam-receiving aperture.

* * * * *